US009919850B2

(12) United States Patent
Bons et al.

(10) Patent No.: US 9,919,850 B2
(45) Date of Patent: Mar. 20, 2018

(54) VENTED FITMENT FOR FLEXIBLE POUCH

(71) Applicant: ECOLAB USA INC, St. Paul, MN (US)

(72) Inventors: Joseph Steven Bons, Oakdale, MN (US); Christopher John Opelt, Hampton, MN (US)

(73) Assignee: Ecolab USA Inc., Saint Paul, MN (US)

( * ) Notice: Subject to any disclaimer, the term of this patent is extended or adjusted under 35 U.S.C. 154(b) by 173 days.

(21) Appl. No.: 13/764,840

(22) Filed: Feb. 12, 2013

(65) Prior Publication Data

US 2014/0226922 A1 Aug. 14, 2014

(51) Int. Cl.
*B65D 47/32* (2006.01)
*B65D 75/58* (2006.01)

(52) U.S. Cl.
CPC ..... *B65D 47/32* (2013.01); *B65D 75/5877* (2013.01); *B65D 2205/00* (2013.01); *Y10T 137/3084* (2015.04)

(58) Field of Classification Search
CPC ..... B65D 51/1616; B65D 47/32; B65D 75/5877; B65D 2205/00; A23L 3/3436; B01D 46/0002; B01D 46/10; B29C 2045/14803; Y10T 137/3084
USPC ..... 383/100–103, 43–45; 215/261, 307, 308, 215/311
See application file for complete search history.

(56) References Cited

U.S. PATENT DOCUMENTS 3,951,293 A * 4/1976 Schulz ..... 215/261
3,998,255 A 12/1976 Mather et al.
4,298,358 A 11/1981 Ruschke
4,332,845 A * 6/1982 Nawata et al. ..... 206/204
4,512,771 A 4/1985 Norton
4,765,499 A * 8/1988 von Reis et al. ..... 215/261
4,793,509 A * 12/1988 Coleman ..... 220/203.08
(Continued)

FOREIGN PATENT DOCUMENTS

JP 56094737 U1 7/1981
JP 07165272 A 6/1995
(Continued)

OTHER PUBLICATIONS

JP 2008-133007, Ko Shitsufun—English Jun. 12, 2008.
(Continued)

*Primary Examiner* — Peter Helvey
(74) *Attorney, Agent, or Firm* — McKee, Voorhees & Sease, PLC

(57) ABSTRACT

An insert assembly for a fitment used with a pouch containing a liquid product producing an off-gas is provided. The assembly includes a vented insert for use with the vented fitment allowing the off-gas to pass there through. A carrier is configured to be attached to the vented insert and includes a liquid impermeable membrane attach to the carrier and fluid coupled to the fitment and insert to allow gas from the product to pass there through. The membrane, which can comprise an EPTFE material allows the gas to pass through, while preventing the liquid product from passing through a wall of the pouch. The insert assembly can be selectively opened and closed to allow or prevent the off-gas produced by the product to pass through the assembly as needed to reduce the pressure within the pouch or container.

20 Claims, 6 Drawing Sheets

(56) References Cited

U.S. PATENT DOCUMENTS

| | | | | |
|---|---|---|---|---|
| 5,171,439 | A | 12/1992 | Vakharia | |
| 5,882,454 | A | 3/1999 | Baginski et al. | |
| 5,988,414 | A | 11/1999 | Schwarz et al. | |
| 5,988,426 | A * | 11/1999 | Stern | 220/371 |
| 6,202,871 | B1 * | 3/2001 | Kelly | B65D 41/3423 215/307 |
| 6,274,209 | B1 * | 8/2001 | Pagidas et al. | 428/35.7 |
| 6,360,540 | B1 * | 3/2002 | Kottmyer | 60/585 |
| 6,651,845 | B1 | 11/2003 | Schroeder | |
| 7,066,337 | B2 * | 6/2006 | Hsu | 210/452 |
| 7,201,287 | B2 * | 4/2007 | Maenke | 220/203.11 |
| 7,255,354 | B2 * | 8/2007 | Tamura et al. | 277/650 |
| 7,328,820 | B2 * | 2/2008 | Young | B65D 47/0838 215/235 |
| 7,357,266 | B2 * | 4/2008 | Giblin | B65D 25/42 215/261 |
| 8,277,295 | B2 * | 10/2012 | Yano | H05K 5/068 361/694 |
| 8,814,993 | B2 * | 8/2014 | Yano | H05K 5/0213 55/385.4 |
| 2002/0056695 | A1 * | 5/2002 | Boulange et al. | 215/261 |
| 2002/0066714 | A1 | 6/2002 | Mainquist et al. | |
| 2002/0084294 | A1 * | 7/2002 | Paulovich | B65D 51/1616 222/482 |
| 2002/0153386 | A1 * | 10/2002 | Uetake | A61F 9/0008 222/1 |
| 2002/0190428 | A1 * | 12/2002 | Tamura | B29C 45/14336 264/259 |
| 2006/0180613 | A1 * | 8/2006 | Manesis | A61F 9/0008 222/189.09 |
| 2006/0249476 | A1 * | 11/2006 | Albers | B65D 51/1688 215/307 |
| 2008/0041624 | A1 * | 2/2008 | Sasaki | H05K 5/0213 174/520 |
| 2008/0290062 | A1 * | 11/2008 | Luzaich | B65D 39/0076 215/307 |
| 2009/0090690 | A1 * | 4/2009 | Walton | B67D 3/0032 215/307 |
| 2009/0230079 | A1 * | 9/2009 | Smolko | B65D 41/0442 215/261 |
| 2010/0001001 | A1 * | 1/2010 | Seline | B65D 51/1616 220/371 |
| 2010/0224629 | A1 | 9/2010 | Schroeder | |
| 2013/0055898 | A1 * | 3/2013 | Yano | H05K 5/0213 96/4 |

FOREIGN PATENT DOCUMENTS

| | | | |
|---|---|---|---|
| JP | 10165787 | A | 6/1998 |
| JP | 2008-133007 | * | 6/2008 |
| JP | 2008133007 | | 6/2008 |
| JP | 2008133008 | A | 6/2008 |
| JP | 2008168950 | A | 7/2008 |
| JP | 2011052180 | A | 3/2011 |

OTHER PUBLICATIONS

Ecolab USA Inc., PCT/US2014/015493 filed Feb. 10, 2014, "The International Search Report and the Written Opinion of the International Searching Authority, or the Declaration", dated May 23, 2014.

* cited by examiner

VENTED FITMENT FOR FLEXIBLE POUCH

FIELD OF THE INVENTION

The present invention relates generally to a vented insert for a product containment system. More particularly, but not exclusively, the present invention relates to an insert assembly for a pouch fitment used to vent a flexible pouch container containing a product emitting a gas.

BACKGROUND OF THE INVENTION

One type of container used for storing products is a flexible container or pouch. A flexible container or pouch has limitations, particularly when used to store products that require ventilation. For example, peroxide-based cleaners are best stored and used from a container or pouch that includes a ventilation system. Some containers and pouches include a fitment for delivery and dispensing product to and from the container or pouch. The fitment includes a passageway or passage that can be selectively opened or closed, or can be fluidly controlled to open and close, to allow a gas or gases to be emitted from the pouch, reducing the pressure therein. An insert can be inserted into the fitment to aid in controlling whether the gas is allowed to escape.

One concept has been to use a vented membrane on a separate fitment with vented closure. However, the membrane has been known to wet out when the product in the container sloshed around in the container and came in contact with the vented membrane material. This fitment concept utilizes a check ball inside an angled channel and a vented closure. It is because of this that keeping the membrane dry is particularly difficult in a flexible package.

Therefore, there is a need in the art for an improved method and means for venting a pouch, such as a flexible pouch, that contains a product that emits a gas during transport, storage, and/or use of the product. There is also a need in the art for a new venting fitment that will not wet out the venting membrane in the assembly.

SUMMARY OF THE INVENTION

Therefore, it is principal object, feature, and/or advantage of the present invention to provide an apparatus that overcomes the deficiencies in the art.

It is another object, feature, and/or advantage of the present invention to provide an apparatus or assembly that allows for the venting of a flexible container or pouch containing a gas-emitting product.

It is still another object, feature, and/or advantage of the present invention to provide an apparatus or assembly that limits or prevents the liquid product from wetting out a membrane of the assembly.

It is yet another object, feature, and/or advantage of the present invention to provide an apparatus or assembly that can be easily attached to existing inserts and/or fitments.

It is a further object, feature, and/or advantage of the present invention to vent a flexible pouch by using a fitment with a vented membrane on the outside of the package away from the product.

It is yet a further object, feature, and/or advantage of the present invention to aid in ensuring the correct orientation of an insert in a fitment.

These and/or other objects, features, and advantages of the present invention will be apparent to those skilled in the art. The present invention is not to be limited to or by these objects, features and advantages. No single embodiment need provide each and every object, feature, or advantage.

According to an aspect of the present invention, an insert assembly for a pouch fitment for use with a pouch containing a product is provided. The assembly includes a vented insert comprising a passage. A carrier is operatively attached to the insert. A membrane is attached to the carrier and is fluidly coupled to the passage to allow gas from the product to pass therethrough. The membrane may be an expanded polytetrafluoroethylene (ePTFE) with or without a polyethylene backing. The membrane may be sized to cover or block an opening through the carrier to vent the product in the pouch.

According to another aspect of the invention, a venting assembly for aiding the venting of a pouch containing an off-gassing product is provided. The assembly includes a carrier comprising an opening extending from a first end to a second end, and including an inner wall and an outer wall. A membrane can be attached to the carrier such that the membrane blocks an area substantially equal to the area within the inner wall of the carrier. The membrane comprises a liquid impermeable material, and can be positioned at the first end of the carrier, the second end of the carrier, or anywhere generally between the first and second ends.

According to yet another aspect of the invention, a product containment system is provided. The system includes a container configured to hold a liquid product, and can be flexible or rigid. A fitment is coupled to the container. A vented insert in the fitment is positionable between an open position and a closed position. A venting assembly is attached to the vented insert, the venting assembly comprising a carrier having an opening therethrough and a liquid impermeable membrane attached to the carrier. The membrane of the venting assembly allows a gas from the liquid product to pass through the venting assembly when the vented insert is in the open position.

DETAILED DESCRIPTION OF THE PREFERRED EMBODIMENTS

Figure 1:
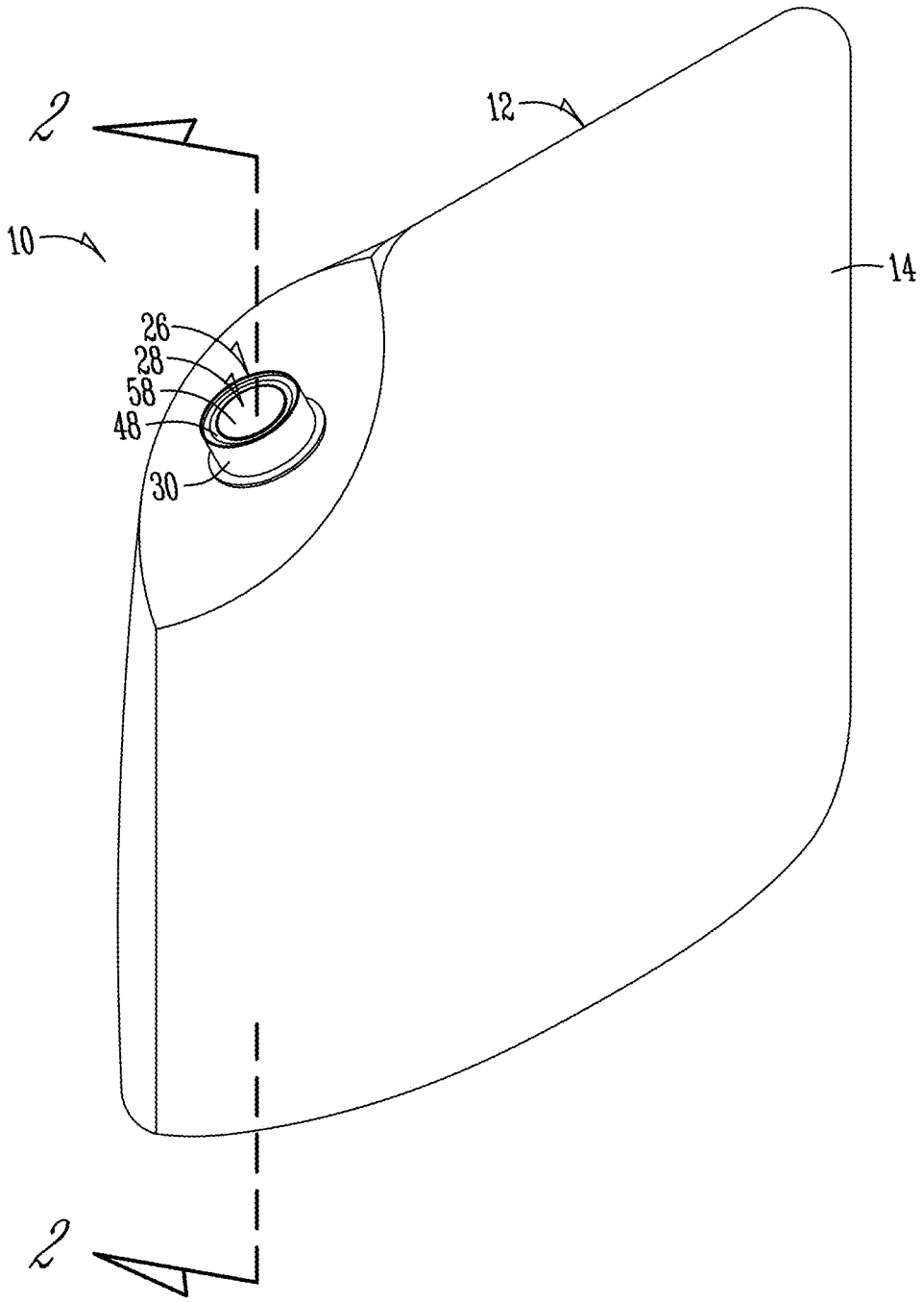
FIG. 1 is a perspective view of a product containment system according to one aspect of the invention.
Figure 2:
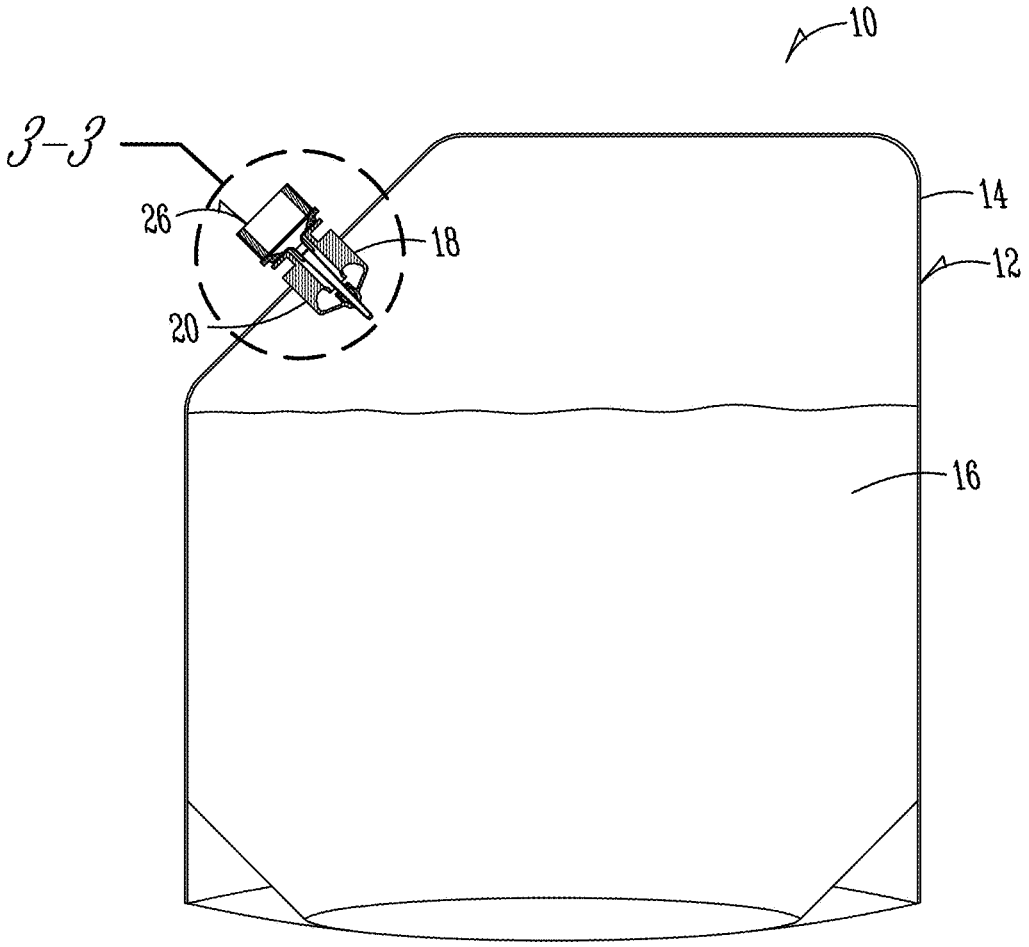
FIG. 2 is a sectional view taken along line 2-2 in FIG. 1.

FIG. 1 is a perspective view of the containment system 10. The containment system 10 includes a container or pouch 12 having a container wall 14. A product 16, as shown in FIG. 2, is contained within the pouch 12 for both transfer of the product and for holding the product 16 before and during dispensing of the product that a dispenser (not shown) or other final destination. The product 16 may comprise a chemistry that contains peroxide or other element that requires venting due to the off-gas produced by said product 16. For example, it is known that peroxide produces an off-gas such that the gas would increase the pressure within the container 12, which could damage a wall 14 of the container 12. This could cause the container 12 to tear or rip, making the product 16 useless.

Therefore, as shown in the figures, insert assembly 26 and venting assembly 28 are included with the container 12 to allow the off-gas of the product 16 to be vented through the wall 14 of the container 12. As shown in FIGS. 1 and 2, the insert assembly 26 is positioned through the wall 14 of the container 12. The insert assembly 26 generally includes a fitment 18 extending through the wall 14 of the product and at venting assembly 28 operatively attached to the fitment 18, as will be discussed in greater detail below. The insert assembly 28 is moveable between an open and closed position, such that in the open position, the off-gas produced by the product 16 is allowed to escape through the insert assembly 26 to reduce the pressure within the container 12 of the containment system 10.

Figure 3:
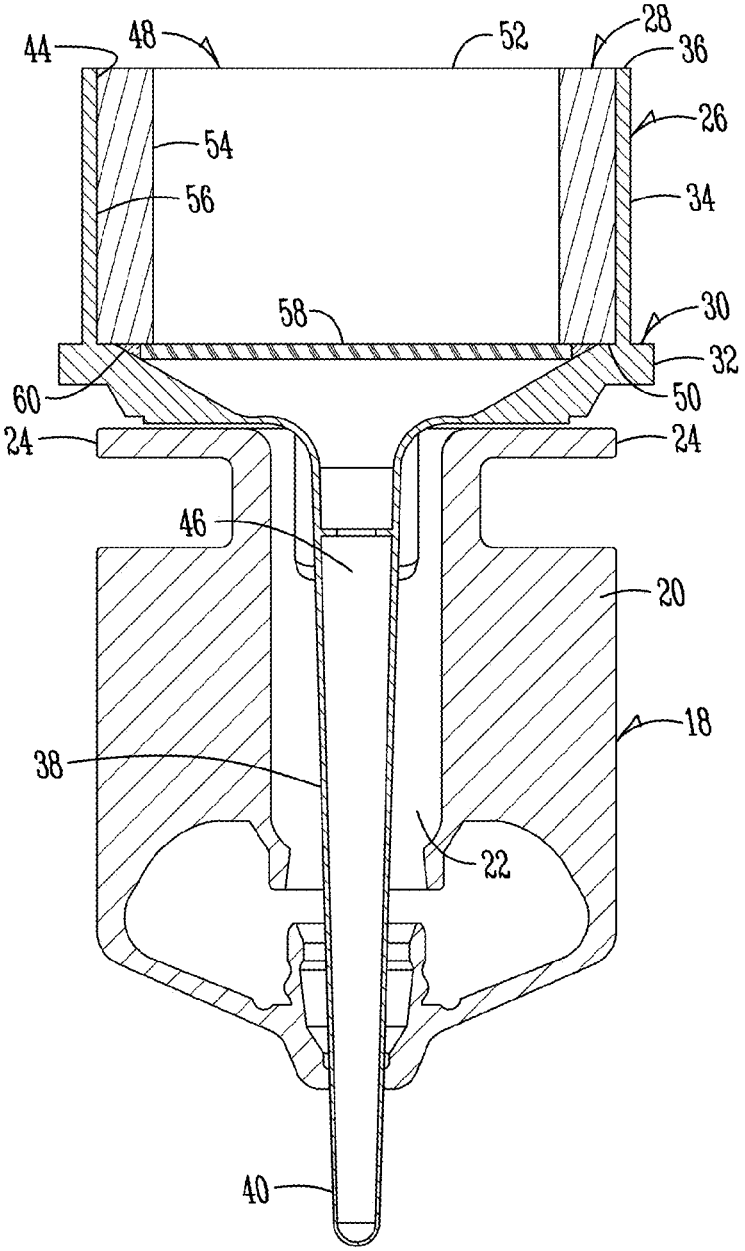
FIG. 3 is an illustration of an insert assembly and corresponding fitment taken along line 3-3 in FIG. 2.

FIG. 3 show the cross sectional view of the insert assembly 26 for use with the containment system 10 of the present but according to embodiment of the present invention. As shown, the assembly includes a fitment 18 with an insert 30 extending through a passage 22 and a fitment body 20. As stated, the fitment 18 includes a fitment body 20 with a fitment passage 22 extending there through. The fitment 18 also includes a flange 24 at an end of the fitment body 20 that is external of the product container 12. The insert 30 includes generally an insert body 32 including an enlarged portion 34 at an outer or second end 36 of the insert body 32. The insert 30 also includes elongated portion 38 at an inner or first portion of the insert body 40. Position generally on the elongated portion 38 of the insert body 32 is a protuberated portion 42. As shown in FIG. 3, the elongated portion 38 of the insert body 32 is configured to the inserted within the fitment passage 22 of the fitment body 20. In addition, the protuberated portion 42 of the insert body 32 is configured to be fitted to the fitment body 20 such that in a close position, the protuberated portion 42 blocks passage through the fitment passage 22, while in an open position, the insert 30 is slid in an upward direction such that the protuberated section allows for passage of gas and/or liquids through the fitment passage 22. The insert 30 may also include an insert passage 46 for allowing passage of fluids through. In addition, the enlarged portion 34 of the insert body 32 may be configured to the hallow such that it includes an interior 44 portion of the wall of the enlarged portion 38. One example of a fitment insert that may be used with the present invention may be models number sps4 female and males obtained from IPN group, 700 dividend drive, suite 500, Peach Tree City, Ga. 30269. Furthermore, the fitment insert 18, 30 are disclosed in U.S. Pat. No. 6,126,045, which is here and incorporated in its entirety. However, it should be appreciated that other model numbers and manufacturers may be used for the fitment 18 and insert 30. In addition, the fitment 18 and insert 30 may be custom made to perform or have the desired characteristics for the different purposes of the invention.

Figure 4:
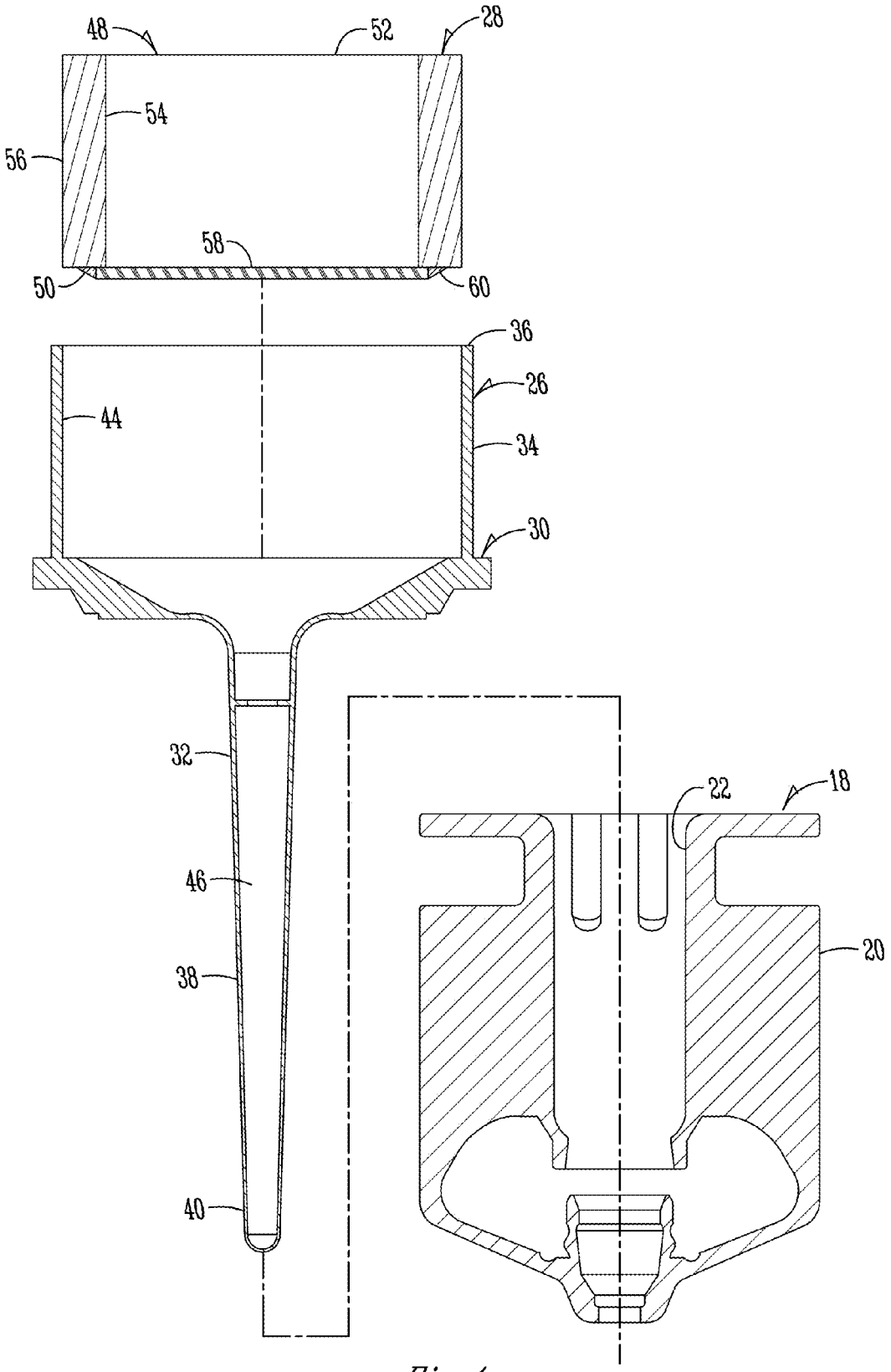
FIG. 4 is an exploded view of the insert assembly and corresponding fitment shown in FIG. 3.

As shown in FIGS. 3 and 4 as part of the venting assembly 28, a carrier 48 having a first end 50 opposite a second end 52 is positioned within the hallow elongated portion 38 of the inserted 30. The carrier is shown to have an inner wall 54 and an outer wall 56 defining an opening 55 there through. Therefore, the carrier 48 may be considered to be a hallow member having both ends open there through. The shape of the carrier 48 is configured to be compatible with or match up with the shape of the interior 44 of the elongated portion 38 of the inserted 30. Thus, when the elongated portion 38 is circular shape, the carrier 48 will also be circular shaped with an opening there through. However, it should be appreciated that both of the elongated portion 38 and the carrier 48 may comprise generally any shape. According to the embodiment of the invention, the carrier 48 is sized to the friction fit within the interior 44 of the elongated portion 38 of the insert 30. Thus, the outer wall 56 of the carrier 48 shall be nearly equal to the size of the interior 44 of the elongated portion 38 such that when the carrier is positioned in the interior 44 of the enlarged portion 34 of the insert 30, the carrier 48 will be maintained in place and will not easily move within the interior 44 of the enlarged portion 34.

Figure 5:
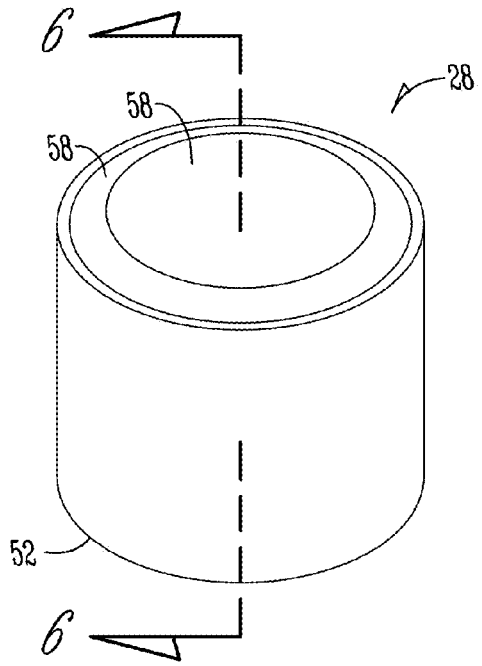
FIG. 5 is a perspective view of a venting assembly according to an aspect of the present invention.

Also shown in the figures is a membrane 58 connected to the carrier 48. The membrane 58 comprises a liquid impermeable material, such as ePTFE. This particular material allows for gases to pass there through, while not allowing any liquid to pass there through. Thus, the membrane would allow the off-gas produced by the product 16 in the container 12 to pass there through, while insuring that the product 16 itself does not leak or escape through the insert assembly 26 of the containment system 10. However, it should be appreciated that other materials capable of being liquid impermeable, while allowing a gas to pass through well, can also be used with the present invention. Furthermore, the membrane may include polyethylene (PE) portion 60, such as a PE back lay. The carrier 48 may compromise polyethylene. Therefore, the PE back lay or portion 60 attached to the membrane 58 may be used to attach the membrane 58 to the carrier 48. For example, as shown best in FIG. 5, the PE portion 60 may be sized larger than the membrane 58. Thus, the PE portion 60 can therefore be attached to a portion of the carrier 48. That's shown in FIG. 5, the membrane 58 may be attached to a first end 50 of the carrier 48 with the membrane 58 extending there from. The PE back lay 60 can then be adhered or fixed to the carrier to the first end 50 of the carrier 48 such as by welding the PE back lay 62 the PE carrier 48. The welding, as is shown by numeral 62 in the figure, may be accomplished by heat, high frequency, ultra sonic welding, friction welding, laser welding, or the like. The specific type of welding is not to limit the present invention, in the present invention is contemplated to include all and any types thereof. Furthermore, the PE portion 60 of the membrane 58 may also be fixed to the carrier 48 by means other than welding. For example, an adhesive may be used to attach the PE portion 60 and membrane 58 to the carrier 48. Furthermore, it is to be appreciated that the membrane 58 need not require a PE portion in all configurations. For example, the membrane may be adhered or fixed to the carrier 48 by itself, by such means as adhesives or the like.

Figure 6A:
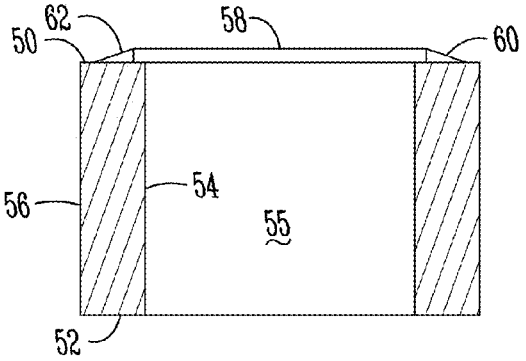
FIGS. 6A-6C are sectional views showing embodiments of the venting assembly.
Figure 6B:
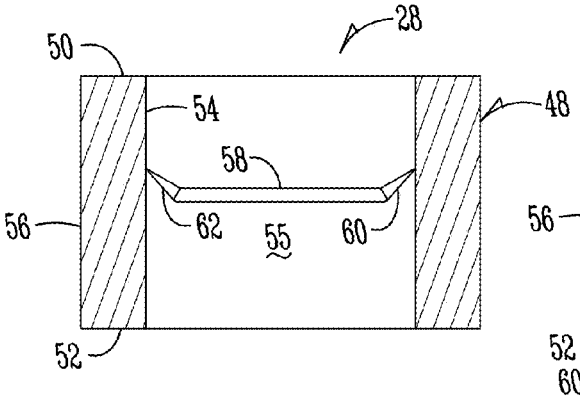
Figure 6C:
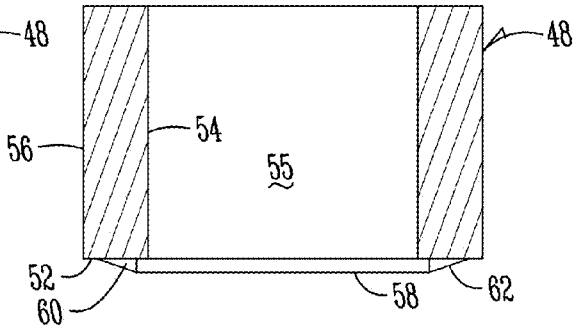

FIG. 6*a* through 6*c* show additional embodiments of a venting assembly 28 for use with the present invention. As discussed thus far, the venting assembly 28 includes a carrier 48 with a membrane 58 including a PE portion 60 attached to a first end 50 of the carrier 48. The membrane is positioned to be oriented such that the membrane will be in direct contact with the passage ways 22, 46 of the insert 30 and fitment 18. Thus, the membrane will allowed the off-gas produced by the product 16 to pass there through, while not allowing the liquid product 16 itself to pass through. The venting assembly 28 may therefore be used to correctly orient the membrane 58 adjacent the liquid product 16 quickly and easily. For example, once the fitment 18 and insert 30 of the insert assembly 26 are positioned in the pouch 12, the venting assembly 28 including the correctly oriented membrane 58 attached to the carrier 48 can be inserted into the interior 44 of the enlarged portion 34 of the insert 30. As the carrier is sized to be friction fit within the insert 30, the membrane will be positioned directly adjacent the liquid product 16 such that it will prevent or mitigate any leaking of the product 16 during transport or handling of the containment system 10. This is advantageous as previous attempts to provide preventing of the off-gas produced by a liquid product 16 in a container 12 have not mitigated the amount of leaking, which can wet out the membrane 58 such that the liquid is allowed to pass through the membrane and outside the container.

In certain situations, it may be advantageous to move the location of the membrane 58 relative to the carrier 48. For example, while FIG. 6*a* shows the membrane 58 attached to a first end 50 of the carrier with the membrane 58 portion on the outside and the PE back lay 60 adjacent the interior of the carrier, other configurations may be utilized. FIG. 6*b* shows the membrane position within the opening 55 of the container 48. In this configuration, the PE portion 60 is adhered or welded 62 to the interior wall 54 of the carrier 48 at a position anywhere between the first end 50 and second end 52 of the carrier 48. FIG. 6*c* shows the membrane 58 positioned at the second end 52 of the carrier 48 and the PE portion 60 welded or adhered 62 to the second end 52 of the carrier 48. Positioning the membrane at this position the membrane 58 at this position will allow the liquid product 16 to pass somewhat into the opening 55 of the carrier 48 to provide a greater amount of volume for the container 12. Therefore, it should be appreciated that the membrane 58 may be positioned generally anywhere relative to the carrier 48 to make the venting assembly 28 of the present invention. The exact location of the membrane 58 relative to the carrier 48 may be decided upon the exact composition of the liquid product 16 in the container 12.

Figure 7A:
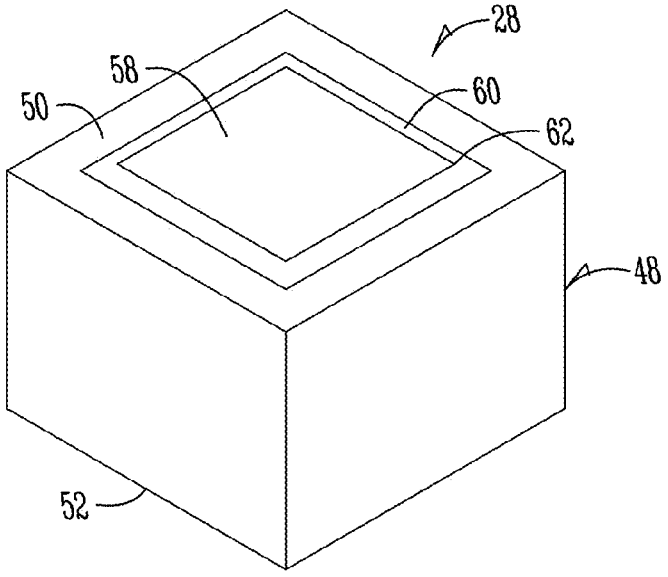
FIGS. 7A-7C are perspective views showing additional embodiments of venting assemblies according to the invention.
Figure 7B:
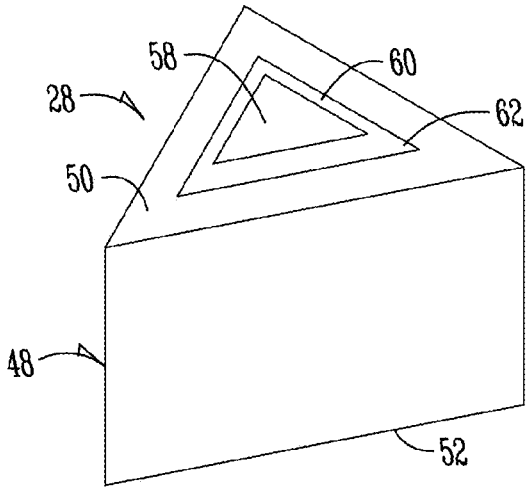
Figure 7C:
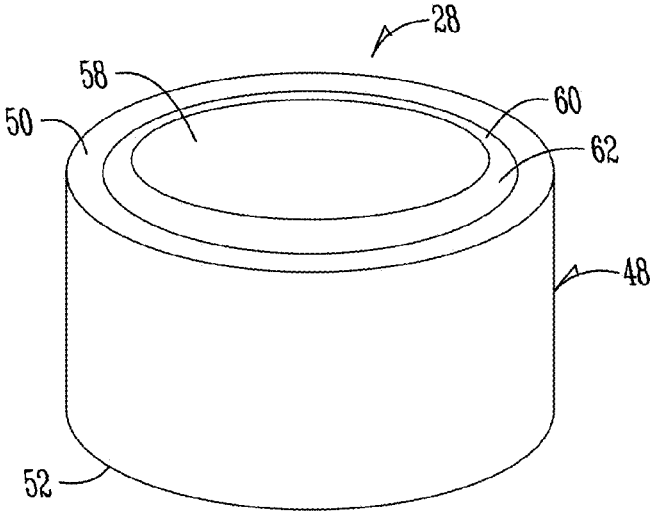

Furthermore, as noted above, the carrier 48 and thus membrane 58 may comprise generally any shape and size. For example, FIG. 7*a* through 7*c* show but a few different shapes that the carrier 48 of the venting assembly 28 may take. FIG. 7*a* shows the carrier 48 in a generally square or rectangular configuration, FIG. 7*b* shows the carrier 48 in a generally triangular configuration, in FIG. 7*c* shows the carrier 48 in a generally oval or oblong shaped configuration. The purpose of the figures is to illustrated the fact that the configuration of the carrier 48, thus membrane 58, should be configured to match the configuration and shape of the insert 30. As stated, in an embodiment of the present invention the carrier 48 is configured to be friction fit within a hallow portion of the insert 30. However, it should also appreciated that the carrier 48 may be adhered or otherwise fixed to the insert 30 by other means. An adhesive may be used, the carrier and insert may be welded together, or other methods may be used to fix or attach the carrier to the insert. Furthermore, it is also contemplated by the present invention that the carrier 48 may not include. In this configuration, the membrane 58, including the PE back lay 60, may be directly attached or adhered to the insert 30 to provide the venting of the off-gas produced by the liquid product 16 in the container 12. For example, the PE portion 60 of the membrane 58 may be directly attached to the interior 44 of the enlarged portion 34 of the insert 30 to allow the gases to pass there through, while preventing the liquid product 16 itself to pass there through.

Therefore, as stated, once the fitment 18 is positioned through the wall 14 of a container 12 including a liquid product 16, the insert 30 including the enlarged portion 34 and elongated portion 38 is inserted through the passage 22 of the fitment body 20. In a closed position, the assembly of the fitment 18 and insert 30 will not allow a gas or liquid to pass there through. However, in an open position, the insert 30 will be moved relative to the fitment 18 to open the passages 22, 46 there through to allow the off-gas produced by the liquid product 16 to pass there through. However, to prevent the liquid product itself from also escaping through the passages, a venting assembly 28 including a carrier 48 and membrane 58 are included in the enlarged portion 34 of the insert 30. The membrane 58, which is positioned at a first end 50 of the carrier 48 is positioned such that an ePTFE composition is positioned adjacent the passages 22, 46 of the fitment 18 and insert 30 such the off-gas will pass through the membrane 58. However, as the membrane is liquid impermeable, the membrane 58 will not allow any liquid product 16 to pass there through, such as during sloshing or transport of the container 12.

Thus, the venting assembly 28 provides and easy to use, easy to orient, and easy to replace assembly for use with an off-gas producing product 16. The as stated, the carrier 48 including the membrane 58 can be easily inserted into the insert 30 such that the membrane 58 is correctly oriented. Furthermore, if by chance the membrane 58 becomes wet out, the carrier quickly and easily removed from the insert 30, and a new venting assembly 28 including a carrier 48 and membrane 58 can be inserted in the insert 30.

The foregoing description has been presented for purposes of illustration and inscription, and is not intended to exhaust a list or to limit the invention precise forms disclosed. It is contemplated that other alternative processes obvious to those skilled in the art are considered to be included in the invention. The descriptions are merely examples of embodiments. For example, while the membrane has been described as an eTPFE material, with a PE back lay, it is contemplated that other materials may be used for both of these the membrane and/or the back lay. In addition, it has also been stated that the carrier 48 comprises polyethylene. It is contemplated that other materials may be used to make the carrier 48. Also as discussed, sizes shapes and other configurations of fitment 18, insert 30, carrier 48, and membrane 58 may also be varied according to different embodiments of the present invention. It is understood that any other modifications, substitutions, and/or additions may be made, which are within the intended spirit and scope or the invention. On the foregoing, it can be seen the present invention accomplishes at least all the stated objectives.

What is claimed is:

1. An insert assembly for a pouch fitment for use with a pouch containing a liquid product, comprising:

a vented insert including an elongated body comprising a passage and an enlarged portion extending away from an end of the body, said passage being narrower than the enlarged portion, and said vented insert slidably positionable between an open position and a closed position;

a carrier operatively attached via friction fit to the insert such that at least a portion of the carrier is positioned within the enlarged portion of the insert; and a membrane attached to the carrier and fluidly coupled to the passage to allow gas from the product to pass therethrough; and wherein the membrane allows a gas from the liquid product to pass through the venting assembly when the vented insert is attached to the pouch and in the open position; and wherein at least a portion of the elongated body of the vented extends through a portion of the pouch to lock the vented insert into the open position to continuously vent the liquid product when the vented insert is positioned to extend through the portion of the pouch.

2. The insert assembly of claim 1 wherein the membrane is liquid impermeable.

3. The insert assembly of claim 1 wherein the membrane comprises an expanded polytetrafluoroethylene (ePTFE) and a polyethylene backing.

4. The insert assembly of claim 3 wherein the polyethylene backing of the membrane is attached to the carrier.

5. The insert assembly of claim 1 wherein the carrier comprises a hollow shape having a first end, a second end, an inner wall, and an outer wall.

6. The insert assembly of claim 5 wherein the membrane is attached to the carrier at the first end of the carrier.

7. The insert assembly of claim 5 wherein the membrane is sized substantially equal to the area within the inner wall of the carrier.

8. The insert assembly of claim 5 wherein the membrane is positioned between the first and second ends of the carrier.

9. The insert assembly of claim 5 wherein the carrier is a hollow cylinder shape.

10. A venting assembly for aiding the venting of a pouch containing an off-gassing product, comprising:

a carrier comprising a substantially uniform opening extending from a first end to a second end, and including an inner wall and an outer wall, said inner wall defining the substantially uniform opening, said carrier positioned through a portion of the pouch such that a portion of the carrier is positioned within the pouch and another portion of the carrier is exterior of the pouch;

said carrier positioned at least partially in a vented insert including an elongated body comprising a passage and an enlarged portion extending away from an end of the body;

a membrane attached to the carrier such that the membrane blocks an area substantially equal to the substantially uniform opening area within the inner wall of the carrier;

wherein the membrane comprises a liquid impermeable material, said membrane attached at a location of the carrier that is exterior to the pouch; and wherein the venting assembly is slidably positionable between an open position and a closed position for venting the pouch; and wherein the membrane of the venting assembly is exterior to the pouch and allows a gas from the off-gassing product to pass through the venting assembly when the venting assembly is attached to the pouch and in the open position; and wherein said venting assembly configured in the open position when positioned within the pouch to continuously vent the off-gassing product while positioned in the pouch.

11. The venting assembly of claim 10 wherein the membrane further comprises a back lay, wherein the back lay is attached to the carrier.

12. The venting assembly of claim 11 wherein the back lay is a polyethylene material.

13. The venting assembly of claim 12 wherein the polyethylene material is welded to the carrier.

14. The venting assembly of claim 10 wherein the membrane comprises an expanded polytetrafluoroethylene (ePTFE).

15. The venting assembly of claim 10 wherein the membrane is positioned at the first end of the carrier.

16. A product containment system, comprising:

a pouch container configured to hold a liquid product;

a fitment coupled to the container;

a vented insert in the fitment being slidably positionable to an open position and a closed position, said insert including an elongated body comprising a passage extending through the pouch container and an enlarged portion positioned at and extending at least partially away from the elongated body, said passage being narrower than the enlarged portion, and said vented insert configured to be in the open position when extending through the pouch container to continuously vent the liquid product when the vented insert is connected to the pouch container;

a venting assembly attached to the vented insert and comprising a carrier having an opening therethrough and a liquid impermeable membrane attached to the carrier, said venting assembly attached to the vented insert via a friction fit such that at least a portion of the carrier is positioned within the enlarged portion of the insert; and wherein the membrane of the venting assembly is exterior to the pouch container and allows a gas from the liquid product to pass through the venting assembly when the vented insert is removably attached to the pouch container and in the open position.

17. The product containment system of claim 16 wherein the insert is at least partially within the container.

18. The product containment system of claim 17 wherein the liquid impermeable membrane is outside of the container.

19. The product containment system of claim 16 wherein the membrane comprises an expanded polytetrafluoroethylene (ePTFE) portion and a polyethylene portion.

20. The product containment system of claim 19 wherein the ePTFE portion of the membrane is sized substantially equal to the size of the opening in the carrier.

* * * * *